US005850169A

United States Patent [19]

Hietala

[11] Patent Number: 5,850,169

[45] Date of Patent: Dec. 15, 1998

[54] TUNABLE CAVITY RESONATOR FOR FREQUENCY FILTER

[75] Inventor: Arto Hietala, Oulu, Finland

[73] Assignee: Nokia Telecommunications OY, Espoo, Finland

[21] Appl. No.: 875,199

[22] PCT Filed: Dec. 3, 1996

[86] PCT No.: PCT/FI96/00645

§ 371 Date: Aug. 1, 1997

§ 102(e) Date: Aug. 1, 1997

[87] PCT Pub. No.: WO97/22157

PCT Pub. Date: Jun. 19, 1997

[30] Foreign Application Priority Data

Dec. 8, 1995 [FI] Finland ..... 955918

[51] Int. Cl.[6] ..... H01P 7/06

[52] U.S. Cl. ..... 333/232; 333/235

[58] Field of Search ..... 333/223, 224, 333/226, 231–233, 235, 225

[56] References Cited

U.S. PATENT DOCUMENTS

| | | | |
|---|---|---|---|
| 2,742,617 | 4/1956 | Bondley | 333/233 |
| 4,207,548 | 6/1980 | Graham et al. | 333/225 |
| 4,521,754 | 6/1985 | Ranghelli et al. | 333/224 |
| 5,612,655 | 3/1997 | Stronks et al. | 333/235 X |

FOREIGN PATENT DOCUMENTS

| | | |
|---|---|---|
| 944806 | 1/1996 | Finland . |
| 95/11529 | 4/1995 | WIPO . |
| 96/12321 | 4/1996 | WIPO . |

*Primary Examiner*—Seungsook Ham

*Attorney, Agent, or Firm*—Pillsbury Madison & Sutro LLP

[57] ABSTRACT

A tunable cavity resonator for a frequency filter has a shell in a wall of which is mounted an adjustable-length conductor which has an outer pipe fixed at an outer end to the wall, and an adjusting element made of a flexible material. An adjuster is provided for adjusting the length of the conductor. The adjusting element is partially everted axially of the outer pipe, and has opposite ends connected to the pipe and the adjuster. Axial movement of the adjuster causes half as much change in the effective axial length of the conductor.

4 Claims, 1 Drawing Sheet

TUNABLE CAVITY RESONATOR FOR FREQUENCY FILTER

This application is the national phase of international application PCT/FI96/00645 filed Dec. 3, 1996 which designated the U.S.

BACKGROUND OF THE INVENTION

The present invention relates to a device for filtering frequency, which device comprises a shell and a conductor adjustable in length, which conductor comprises an outer pipe affixed at its first end to the shell and an extruding adjusting element adjustable in the direction of the central axis of the outer pipe at the second, free end of the outer pipe by means of adjusting means for adjusting the length of the conductor, which adjusting element is of a flexible surface material and affixed at its first end to the outer pipe and at its other end to the adjusting means and which adjusting element forms the free end of the conductor.

For example, the filter according to Finnish Patent Application 944,806 comprises an outer pipe attached to the filter shell, adjusting means adapted coaxially inside the outer pipe and adjusting elements adapted between the outer pipe and the end of the adjusting means. When the axial distance of the adjusting means from the outer pipe changes, the frequency of the filter will change as well. The adjusting elements comprise a laminated or film structure bent and attached between the outer pipe and the end of the adjusting means.

The greatest problem with a solution of this type is that this method of adjusting frequency is inaccurate. A travel of one millimeter of the adjusting means corresponds to a frequency deviation of 2.6 MHz with a filter. This means that the frequency of the filter is very difficult to adjust manually to be correct. If a stepping motor moves the adjusting means, a great accuracy is required of the stepping motor in order that the filter will attain the desired frequency.

In the filter of the cited Finnish patent application, the laminated or film structure comprises several separate, adjoining lamellas or films essentially bent into a U shape and attached to one another into an annular structure and the laminated or film structure is attached to the outer pipe and the adjusting means with annular retainers whose periphery has mounting slots for said structure. The mounting of the adjusting element has thus been rather difficult and complicated.

Furthermore, the end of the adjusting film protruding from the outer pipe has not been in the same line as the outer pipe but the adjusting element has protruded essentially perpendicularly away from the line of the outer pipe. However, the object is that the length of the conductor, that is, the length in the direction of the free end of the outer pipe, can be adjusted. If the filter, for example, is also adjusted so that the part of the adjusting element bending most forms as small an angle as possible, such a great stress is directed to the adjusting element that in the worst case it may get damaged.

SUMMARY OF THE PRESENT INVENTION

The object of the present invention is to eliminate the disadvantages described above and improve the device.

The idea of the invention is that the second end of the adjusting element which is attached to the adjusting means is situated closer to the fixture of the outer pipe than the free end of the conductor. This structure provides the advantage that frequency adjustment will be considerably more accurate than in prior art solutions.

The solution of the invention will make the adjustment accuracy of frequency of the filter significantly better than in prior art solutions. In the solution of the invention, the frequency change of the filter corresponding to the travel of one millimeter of the adjusting means is only 1.6 MHz, whereas previously the frequency change has been as much as 2.6 MHz. The more accurate frequency adjustment of the invention is based on that the travel of the adjusting element will be half of that in the prior art solution. This essential improvement in frequency adjustment means that frequency can be easily adjusted just manually to be correct. If frequency adjustment is automatic, that is, a stepping motor moves the adjusting means, the stepping motor requires only a smaller accuracy for attaining the same accuracy as in the prior art solution. The adjusting element adjustable by means of the adjusting means for adjusting the length of the conductor is attached to the adjusting means and the outer pipe in such a manner that the adjusting element forms the free end of the conductor with all the travel values of the adjusting means. In this way, the whole adjusting range will be adjusted accurately.

The adjusting element comprises plate strips, that is, lamellas attached to the adjusting means. The lamellas are bent advantageously into such a U shape that frequency adjustment is almost frictionless and the lamellas form the free end of the conductor. Also, the lamellas are attached to the adjusting means radially, which provides good directional stability for the lamellas. Directional stability of the lamellas can be further improved if the lamellas have a curved shape in the lateral direction. The lamellas may be manufactured of a material with good electroconductivity or they can possibly be manufactured of plastic or any such material, which will make the filter lighter and more economic to manufacture. If the lamellas are produced of plastic or any such material, the lamellas have to be coated with a coating with good electroconductivity, whereby electroconductivity will improve and the lamellas will become a part of a conductor adjustable in length.

BRIEF DESCRIPTION OF THE INVENTION

In the following, the invention will be explained in more detail by means of one preferred embodiment with reference to the attached drawing, where in:

DETAILED DESCRIPTION

Figure 1:
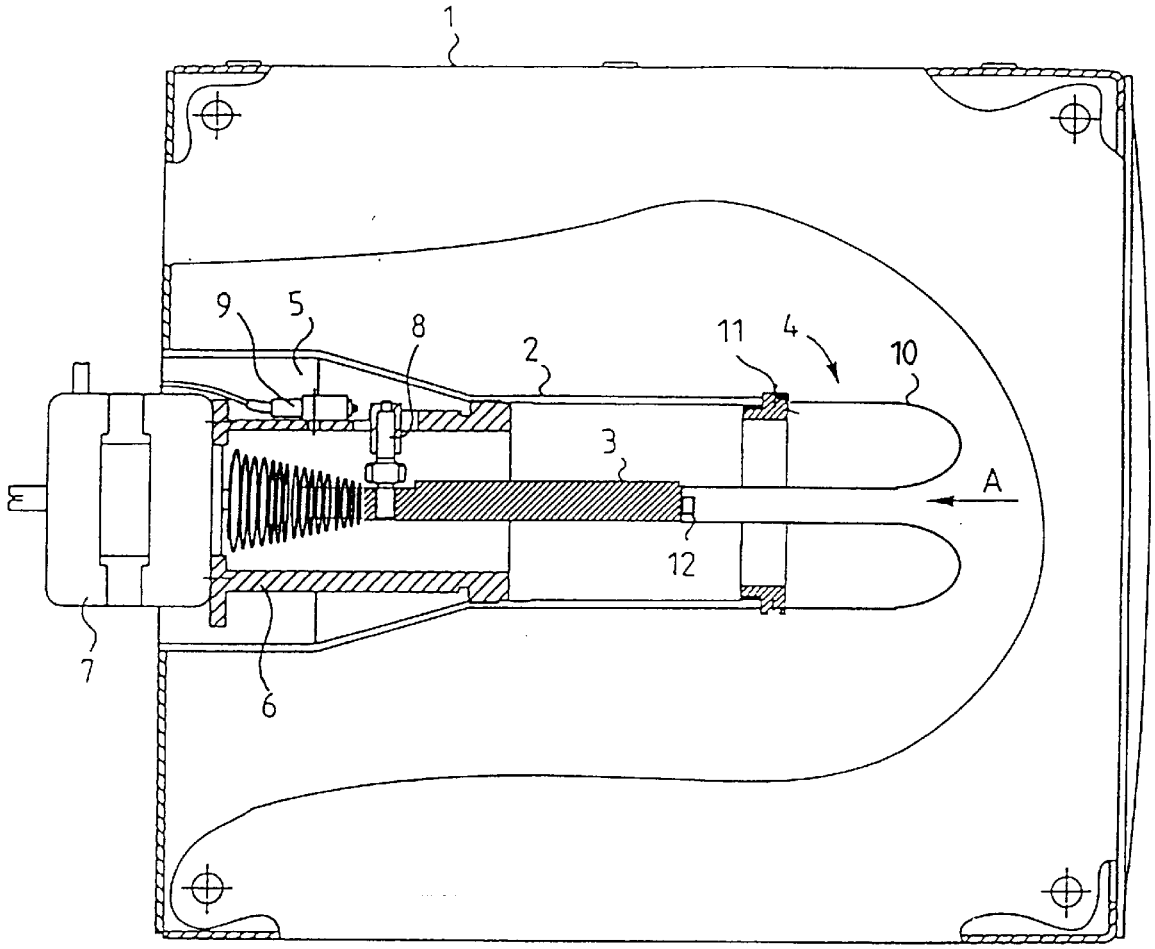
FIG. 1 shows a cross-sectional view of the device of the invention.

FIG. 1 shows a device according to the invention which in this exemplary case is automatically adjustable, comprising an outer pipe 2, preferably made of copper, attached inside a shell 1, adjusting means 3, preferably made of Invar® iron-nickel alloy, adapted coaxially inside the outer pipe, and a flexible adjusting element 4. The adjusting element 4 is attached at its first end to the outer pipe 2, and at its second end to the adjusting means 3 and it is preferably made of a coated surface material, and the axial length of the adjusting element 4 from the free end of the outer pipe 2 is adjustable by the adjusting means 3.

The filter also comprises a stepping motor 7 for moving the adjusting means 3 and adapted into an extension 5 of the outer pipe 2 outside the shell 1 by means of a mounting pipe 6. A suitably dimensioned mounting pipe works here simultaneously as a temperature compensation pipe that compensates for the changes in length caused by temperature changes in the assembly of the outer pipe 2, the adjusting means 3, the adjusting element 4 and the steps of the stepping motor 7. Thus need for the mounting of a separate temperature compensation pipe inside the outer pipe 2 is avoided. An anti-rotation pin of the adjusting means 3 is indicated by numeral 8, and a limit switch of the motor 7 by numeral 9. The limit switch 9 halts the stepping motor 7 when the adjusting means 3 cannot adjust the length of the conductor any more. The adjusting element 4 comprises lamellas 10 which form the free end of the conductor. The lamellas are affixed at their first end to the outer pipe 2 with a first retaining element 11 and at their other end to the adjusting means 3 with a second retaining element 12 which is preferably a screw.

Figure 2:
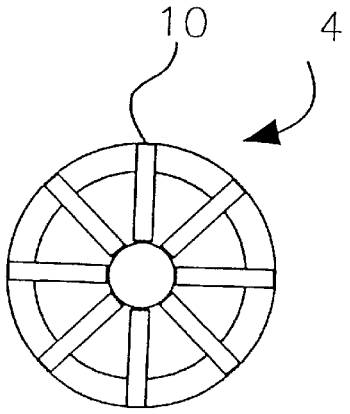
FIG. 2 shows a laminated structure of the device of FIG. 1 viewed from direction A.

FIG. 2 shows that the several separate lamellas 10 of the adjusting element 4 bent essentially into a U shape are connected into a radial structure around the adjusting means 3. In this exemplary case, there are eight lamellas 10. The adjusting means 3 are adapted into the lamellas 10 of the adjusting element 4 bent into a U shape in such a manner that it is possible to adjust the length of the conductor by the adjusting means 3 by adjusting the length of the lamellas 10 of the adjusting element 4. As the length of the conductor varies, the frequency to be adjusted varies as well. Because of the structure of the adjusting element 4, the force required for frequency adjustment will remain small, that is, the filter is light to adjust.

As a material for lamellas it is possible to use copper mixture CuTe ISO 1336, coated plastic or plastic-like coating material coated with a coating with good electroconductivity. The material of the retainer 11, with which the first end of the adjusting element 4 is attached to the outer pipe 2, could, e.g., copper mixture CuSn SFS 2933.

Figure 3:
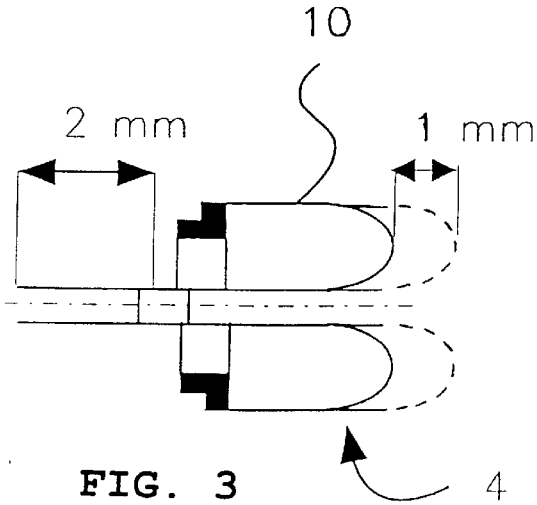
FIG. 3 shows the travel of the peak, which adjusts the frequency of the laminated structure of the invention, with respect to the travel of the adjusting means.

FIG. 3 shows a cross sectional view of the adjusting element 4 where two lamellas 10 are attached at their first end to the outer pipe 2 and at their second end to the adjusting means 3. The lamellas 10 form a free end of the conductor which is essentially U shaped. In the figure, the travel of the adjusting means 3 is two millimeters, whereas the travel of the adjusting element 4 is only one millimeter. This means that frequency adjustment of the filter has such a structure that the travel of the free end of the conductor determining the frequency of the filter is only half of the distance travelled by the adjusting means 3. In practice, this means that by means of the solution of the invention, it is very easy to have the filter tuned accurately onto the required frequency.

The invention has been explained above only by means of one preferred embodiment. However, a person skilled in the art can realize its details in various alternative ways within the scope of the attached claims.

I claim:

1. A tunable cavity resonator for a frequency filter, comprising:

a shell;

an adjustable-length conductor comprising an outer pipe affixed at an axially outer end thereof to said shell and extending in a direction within the shell along a central axis of the outer pipe, to an inner end thereof, and an adjusting element which is adjustable in said direction;

an adjuster for adjusting the length of said conductor;

said adjusting element being made of a flexible material and having a first end affixed to said outer pipe near said inner end of said outer pipe, and a second end affixed to said adjuster, so as to provide said conductor with a free end on said adjusting element, located between said first and second ends of said adjusting element;

said second end of said adjusting element, where affixed to said adjuster, being situated closer in said direction to said inner end of said outer pipe, where affixed to said first end of said adjusting element, than to said free end of said conductor, and such that axial movement of said adjuster in said direction causes half as much axial movement of said free end of said conductor in said direction.

2. The tunable cavity resonator of claim 1, wherein:

said adjusting element, between said first and second ends thereof is partially axially everted in said direction so as to be generally U-shaped in longitudinal sectional profile.

3. The tunable cavity resonator of claim 2 wherein:

between said first and second ends thereof, said adjusting element comprises a plurality of angularly spaced lamellas.

4. The tunable cavity resonator of claim 3 wherein:

said lamellas are made of flexible plastic material having a coating of electrically conductive material.

* * * * *